US007046107B2

(12) United States Patent
Yamamoto et al.

(10) Patent No.: US 7,046,107 B2
(45) Date of Patent: May 16, 2006

(54) CONTACT DEVICE

(75) Inventors: Ritsu Yamamoto, Kyotanabe (JP); Riichi Uotome, Katano (JP); Kouji Yokoyama, Osaka (JP)

(73) Assignee: Matsushita Electric Works, Ltd., Osaka (JP)

( * ) Notice: Subject to any disclaimer, the term of this patent is extended or adjusted under 35 U.S.C. 154(b) by 0 days.

(21) Appl. No.: 10/511,136

(22) PCT Filed: Feb. 27, 2004

(86) PCT No.: PCT/JP2004/002455

§ 371 (c)(1),
(2), (4) Date: Oct. 14, 2004

(87) PCT Pub. No.: WO2004/077472

PCT Pub. Date: Sep. 10, 2004

(65) Prior Publication Data

US 2005/0190025 A1 Sep. 1, 2005

(30) Foreign Application Priority Data

Feb. 28, 2003 (JP) ..... 2003-054149
Feb. 28, 2003 (JP) ..... 2003-054150

(51) Int. Cl.
*H01H 67/02* (2006.01)

(52) U.S. Cl. ..... 335/128; 335/83

(58) Field of Classification Search ..... 335/78–86, 335/124, 128, 132, 202

See application file for complete search history.

(56) References Cited

U.S. PATENT DOCUMENTS 4,003,011 A * 1/1977 Hayden ..... 335/196
4,460,881 A * 7/1984 Meister et al. ..... 335/128
5,003,274 A * 3/1991 Chikira et al. ..... 335/83
5,155,459 A * 10/1992 Schmid et al. ..... 335/128
6,075,429 A * 6/2000 Uotome et al. ..... 335/78

FOREIGN PATENT DOCUMENTS

JP 56-000017 U1 6/1979
JP 01-098423 U1 6/1989
JP 03-076348 U1 7/1991
JP 09-293421 A1 11/1997
JP 2000-340087 A1 12/2000

OTHER PUBLICATIONS

International Search Report for PCT/JP2004/002455 mailed on May 11, 2004.

* cited by examiner

*Primary Examiner*—Lincoln Donovan
(74) *Attorney, Agent, or Firm*—Rader, Fishman & Grauer PLLC

(57) ABSTRACT

Each movable contact 15 is given a first force by a drive mechanism along a direction for bringing the movable contact into contact with a fixed contact 5 and given a second force through a leg 14*b* by deformation of a supporting member 14*c* resulted from an overtravel of the movable plate 14. The fixed contact and the movable contact are arranged such that a resultant force of the first and the second forces acts in a direction normal to a contact surface defined between the fixed contacts and the movable contacts. So, a component force of the resultant force parallel to the contact surface is not generated, therefore, a side slip of the movable contact can be prevented when the contacts are opened or closed.

8 Claims, 6 Drawing Sheets

CONTACT DEVICE

TECHNICAL FIELD

The present invention relates to a contact device suitable for a high-load relay, an electromagnetic relay, etc.

BACKGROUND ART

Japanese Non-examined Patent Publication No. 2000-340087 discloses a conventional contact device. The conventional contact device comprises a fixed contact; a movable contact coming into contact with and separating from the fixed contact; a movable plate carrying the movable contact; a drive mechanism which drives the movable plate to make the contacting engagement of the movable contact with the fixed contact; and a housing which houses the fixed contact, the movable plate, and the drive mechanism. The movable plate is a Z shape having a contact member carrying the movable contact on its one surface, a leg upstanding from the contact member, and a supporting member which is coupled at its one end to the leg and is fixed at the other end to the drive mechanism. When the drive mechanism is energized, the movable plate moves downward to bring the movable contact into contact with the fixed contact.

In this kind of contact device, when the movable plate overtravels after the movable contact came into contact with the fixed contact, the supporting member is deformed, which gives a contact pressure to the contacts. As shown in FIG. 12A, the contact pressure is a resultant force F of two forces F1 and F2; the force F1 is a force applied to the movable contact 100 by the movable plate 120 along a moving direction of the movable contact 100 for bringing the movable contact 100 into contact with the fixed contact 110 (downward direction in FIG. 12A), and the force F2 is a force applied to the movable contact 100 by deformation of the supporting member 120*a* through the leg 120*b*. The force F2 intends to open the leg 120 outward. Therefore, in this conventional contact device shown in FIG. 12A, a component force F3 parallel to a contact surface defined between the movable contact 100 and the fixed contact 110 is generated from the resultant force F, so, as shown in FIG. 12B, the leg 120*b* may pivot about its upper end S, and the movable contact 100 may slip sideways with respect to the fixed contact 110. Such side slip may cause a decrease of the contact pressure between the movable contact 100 and the fixed contact 110, which may increase a contact bounce time, and may cause contact weld, a breaking defect caused by an increase in transfer of a contact material, and a malfunction.

DISCLOSURE OF THE INVENTION

In view of the above problem, the object of the present invention is to provide a contact device which can prevent a side slip of the movable contact when it is switched.

The contact device in accordance with the present invention comprises fixed terminals respectively provided with fixed contacts; a movable plate carrying movable contacts each making a contacting engagement with each one of the fixed contacts; a drive mechanism which drives the movable plate to make the contacting engagement of the movable contacts with the fixed contacts; a housing which accommodates therein the fixed contacts, the movable plate, and the drive mechanism. The movable plate is a Z-shape having a contact member carrying the movable contacts, a leg upstanding from the contact member, and a supporting member which is coupled at its one end to the leg and is fixed at the other end to the drive mechanism.

The movable contacts are given a first force by the drive mechanism along a direction for bringing the movable contacts into contact with the fixed contacts and given a second force by deformation of the supporting member resulted from an overtravel of the movable plate through the leg.

The feature of the present invention resides in that the fixed contacts and the movable contacts are arranged such that a resultant force of the first and second forces acts in a direction normal to a contact surface defined between the fixed contacts and the movable contacts. Therefore, a component force of the resultant force parallel to the contact surface is not generated, so a side slip of the movable contact can be prevented when the contacts are closed.

Preferably, the contact member has a cut between the movable contacts. By this cut, the stiffness of the contact member is decreased, which makes it easy for the contact member to deform in a moving direction of the contact member. Therefore, even if contact pairs have a difference in distance between the movable contact and the fixed contact, the difference can be absorbed by the deformation of the contact member, and the variation of time in which each contact is exposed to an arc is reduced. Therefore, variations in the amount of wear of the contact material and the amount of transfer of it do not arise, so a malfunction where some movable contact does not come into contact with the fixed contact can be prevented.

More preferably, the leg has a protrusion running along a direction in which the leg upstands. Such protrusion enhances the strength of the leg, and can prevent the buckling of the leg.

It is also preferable that a protrusion which is in contact with both surfaces of the leg and the contact member is provided at a connecting part between the leg and the contact member. Such protrusion enhances the strength of the connecting part and can prevent a change of an angle formed by the leg and the contact member. By preventing the change of the angle, a state where the resultant force acts in the direction normal to the contact surface can be maintained.

It is also preferable that the contact member has two movable contacts, and the leg upstands from a line joining each center of the two movable contacts. In this case, even if the angle formed by the leg and the contact member varies, the variation of an angle of the movable contact can be minimized because a distance from the connecting part between the contact member and the leg to the movable contact is shortened. By minimizing the variation of the angle of the movable contact, a state where the resultant force acts in the direction normal to the contact surface can be maintained.

It is preferable that the drive mechanism has a bobbin on which a coil is wound, and the housing has a base which each of the fixed terminals penetrates, and the base and the bobbin are integrally molded from the same material along with a stopper for restricting a movement of the movable plate in a direction in which the movable contact separates from the fixed contacts. In this case, the number of parts can be reduced, which enables a simplification of an assembly work and a cost reduction.

It is also preferable that the housing has a base which each of the fixed terminals penetrates, and the base is integrally molded from the same material with an arc-extinguishing box that surrounds the fixed contacts and the movable contacts to extinguish an arc generated between the fixed contacts and the movable contacts.

Alternatively, it is also preferable that the housing comprises a base which each of the fixed terminals penetrates, and an arc-extinguishing cover which is attached to the base so that it surrounds the fixed contacts and the movable contacts to extinguish an arc generated between the fixed contacts and the movable contacts and covers the drive mechanism.

BEST MODE FOR CARRYING OUT THE INVENTION

Hereinafter, the present invention will be described in more detail with reference to the accompanying drawings.

Figure 1A:
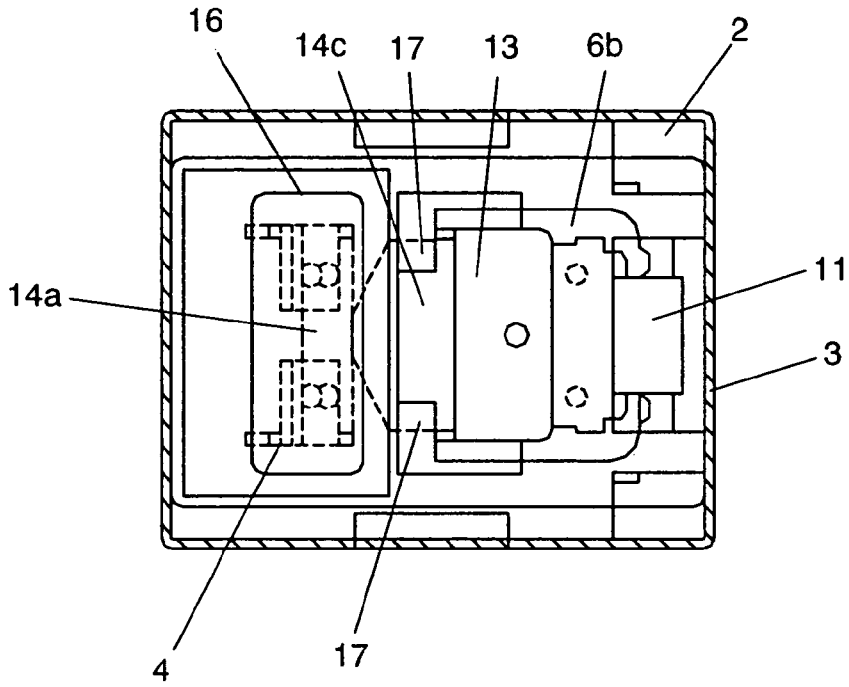
FIG. 1A is a transverse sectional view of a contact device in accordance with an embodiment of the present invention.
Figure 1B:
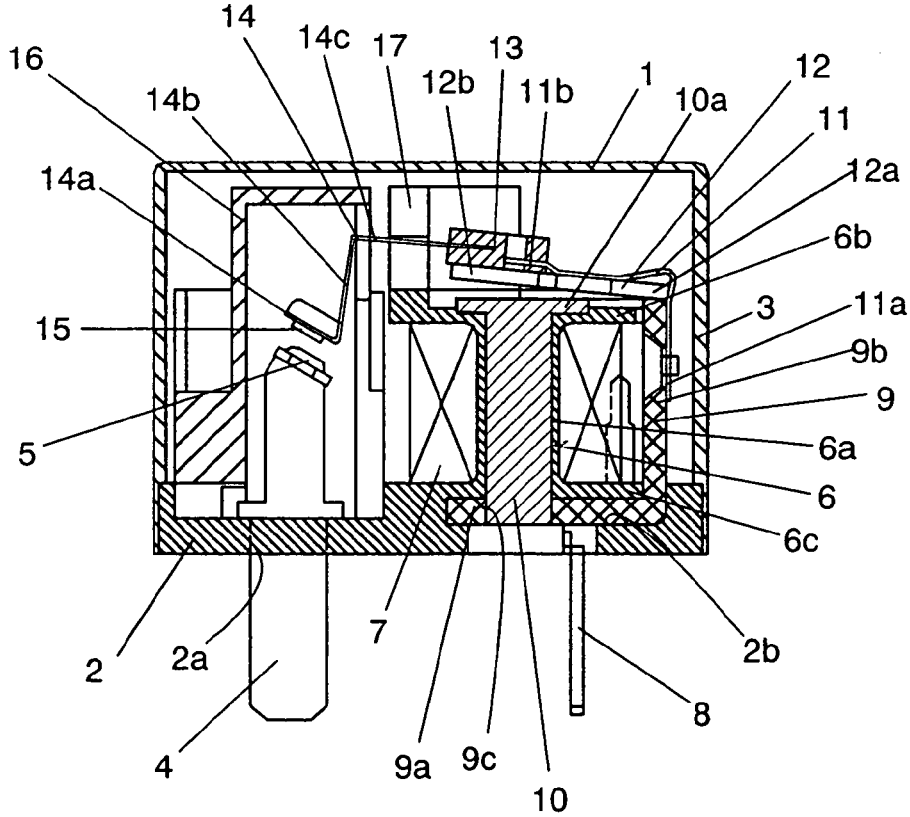
FIG. 1B is a longitudinal sectional view of the contact device.

FIG. 1A and FIG. 1B show a contact device in accordance with a first embodiment of the present invention. A housing 1 of the contact device is composed of a base 2 made of a synthetic resin having an insulating property and a cover 3. A pair of fixed terminal holes 2*a*, 2*a* into which each fixed terminal 4 is inserted is formed through the base 2 at one end in the longitudinal direction of the base 2. The fixed terminal holes 2*a*, 2*a* are located side by side along a direction perpendicular to the longitudinal direction of the base 2. Each of the fixed terminals 4, 4 is a metal plate, one end of which protrudes from the housing 1 through the base 2, and the other end is in the housing 1 and has a fixed contact 5. A mounting angle of the fixed contacts 5, 5 will be described later in detail.

A bobbin 6 is integrally molded with the base 2 using the same synthetic resin at the other end in the longitudinal direction of the base 2. The bobbin 6 has a cylinder-shaped cylindrical section 6*a* and flanges 6*b* and 6*c* at both ends of the cylindrical section 6*a*. A coil 7 is wound on the outer surface of the cylindrical section 6*a*. Both ends of the coil 7 are electrically connected with two coil terminals 8, 8, which penetrate the base 2 near the bobbin 6 side by side in a direction perpendicular to the longitudinal direction of the base 2. A slot 2*b* that has an opening on the right side in FIG. 1 is provided between the base 2 and the flange 6*c* on the base side, into which a cross-member 9*a* of a L-shaped yoke 9 is slid and inserted. The cross-member 9*a* has a circular hole 9*c* which will communicate with the inside of the cylindrical section 6*a* of the bobbin 6 when the yoke 9 is inserted into the slot 2*b*, and one end of a core 10 is pressed thereinto through the inside of the cylindrical section 6*a*. The other end of the core 10 is provided with a pole piece 10*a* that is larger than the cylindrical section 6*a* in diameter. The pole piece 10*a* is on the flange 6*b*.

An L-shaped return spring 11, which is formed by bending a thin plate, is fixed at its one end to a vertical member 9*b* of the yoke 9, and the other end 11*b* of it is fixed to an armature 12. The armature 12, which is formed into a plate shape from a magnetic material, is fixed at its center section to the return spring 11, and is disposed so that one end 12*a* of it is on the upper surface of the vertical member 9*b* of the yoke 9 and the other end 12*b* of it opposes to the pole piece 10*a*. The armature 12 is supported by the return spring 11 so that it can pivot about one end 12*a* , and is energized by the return spring 11 in a direction separating from the pole piece 10*a*. That is, while the coil 7 is not energized, the armature 12 is located in an off-position where the armature is separate from the pole piece 10*a* by spring force of the return spring, and when the coil is energized, the armature 12 pivots against the spring force by magnetic force acting between the armature 12 and the pole piece 10*a*, and the other end 12*b* comes into contact with the pole piece 10*a*. The bobbin 6, the coil 7, the core 10, the yoke 9, the return spring 11, and the armature 12 constitute a drive mechanism.

A movable plate 14 is fixed to the upper surface of the armature 12 through a fixing member 13. The fixing member 13 is made of a synthetic resin, into which one end of the movable plate 14 (a supporting member 14*c*) and the other end 11*b* of the return spring 11 are insert-molded. The movable plate 14 is formed from a metallic thin plate having a spring force, and is formed into a Z-shape having a contact member 14*a* carrying movable contacts 15, 15, a leg 14*b* upstanding from the contact member 14*a*, and the supporting member 14*c* which is coupled at its one end to the leg 14*b* and is insert-molded into the fixing member 13 at the other end, as mentioned above. The movable contacts 15, 15 are disposed on the contact member 14*a* side by side in a direction perpendicular to the longitudinal direction of the base 2 in spaced relation to each other so as to make a contacting engagement with each fixed contact 5. A mounting angle of the movable contacts will be described in detail later.

An arc-extinguishing box 16 for extinguishing an arc generated between the movable contacts and the fixed contacts is provided around the movable contacts 15,15 and the fixed contacts 5, 5. The arc-extinguishing box 16, which is made of a synthetic resin which has an insulating property and excels in an arc extinguishing property, is in the form of a box having openings on the base side and on the drive mechanism side.

The contact device of this embodiment, constituted as above, will work as below.

When the coil terminals 8 are energized to excite the coil 7, the armature 12 is attracted to the pole piece 10*a* against the spring force of the return spring 11 by the magnetic force. And, the movable plate 14 fixed to the armature 12 pivots to bring the movable contacts 15, 15 into contact with the fixed contacts 5, 5. When the armature 12 overtravels toward the pole piece 10*a* after that, the supporting member 14*c* of the movable plate is deformed and gives the contact pressure. When the energization of the coil terminals is stopped, the magnetic force goes off, and the armature 12 is separated from the pole piece 10*a* by the spring force of the return spring 11 to break the contacting engagement of the movable contacts 15, 15 with the fixed contacts 5, 5. The pivot motion of the armature 12 is regulated when the supporting member 14*c* of the movable plate 14 comes in contact with a stopper 17 provided above the flange 6*b* of the bobbin 6.

Hereinafter, the mounting angle of the fixed contacts and the movable contacts will be explained in detail.

Figure 2:
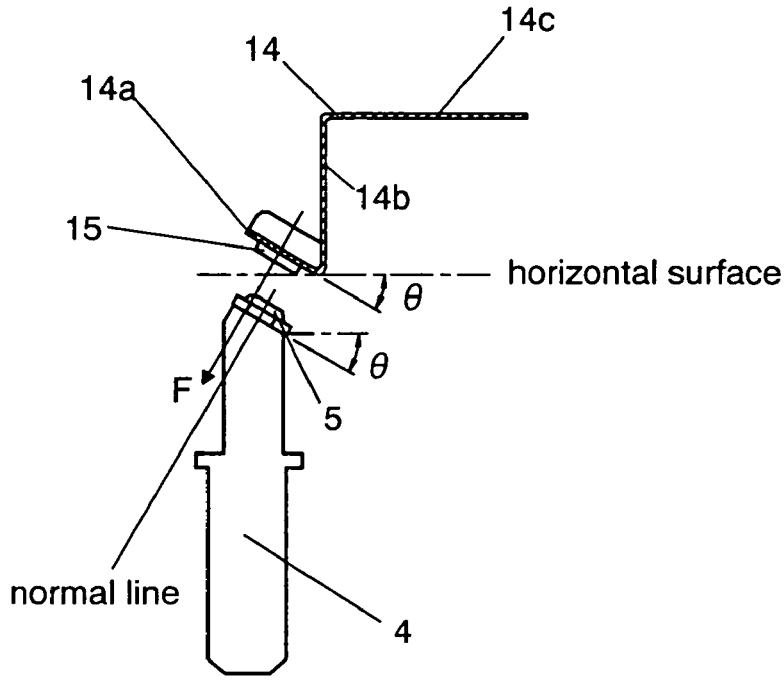
FIG. 2 is a diagram for explaining a mounting angle of a movable contact and a fixed contact of the contact device of FIG. 1.

The contact pressure F between the movable contacts and the fixed contacts is a resultant force of two forces F1 and F2; the force F1 is a force applied to the movable contacts by the movable plate 14 driven by the drive mechanism along the moving direction of the movable plate 14 for bringing the movable contacts into contact with the fixed contacts; the force F2 is a force applied to the movable contacts 14*b* through the leg 14*b* by deformation of the supporting member 14*c* resulted from a movement of the movable plate 14 after the movable contacts came into contact with the fixed contacts (that is, an overtravel of the movable plate 14). In other words, the force F2 is a force that intends to open the leg 14*b* outward by deformation of the supporting member 14*c*. As shown in FIG. 2, in this contact device, the mounting angle of the fixed contacts and the movable contacts are decided so that the contact pressure F acts in a direction normal to a contact surface defined between the fixed contacts and the movable contacts. Therefore, a component force parallel to the contact surface of the fixed contacts and the movable contacts becomes zero, so the movable contacts does not slip sideways with respect to the fixed contacts.

Figure 3:
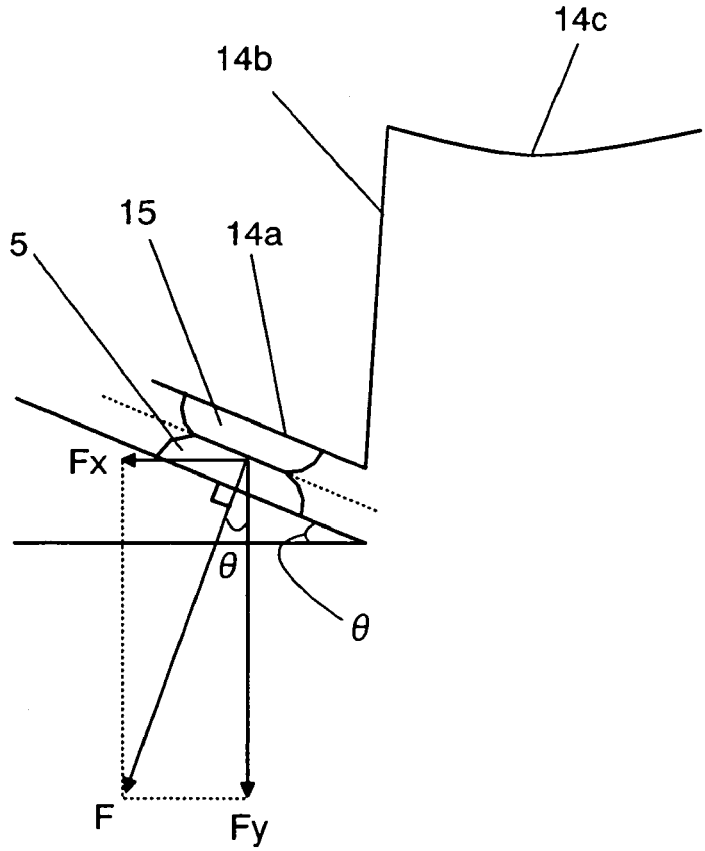
FIG. 3 is a diagram for determining the mounting angle of the movable contact and the fixed contact.

Concretely speaking, the mounting angle e will be determined as follows: first a vertical component force Fy and a horizontal component force Fx of the contact pressure F are measured (or calculated by simulation), as shown in FIG. 3. And then, the vertical component force Fy and the horizontal component force Fx are substituted into the following equation to determine the mounting angle θ:

$$\theta = \arctan(Fx/Fy)$$

In the contact device constituted as mentioned above, because the movable contacts will not slip sideways, a contact bounce time is shortened, and contact weld, a breaking defect, and a malfunction can be prevented. Therefore, the reliability of the contact device is improved.

Figure 4A:
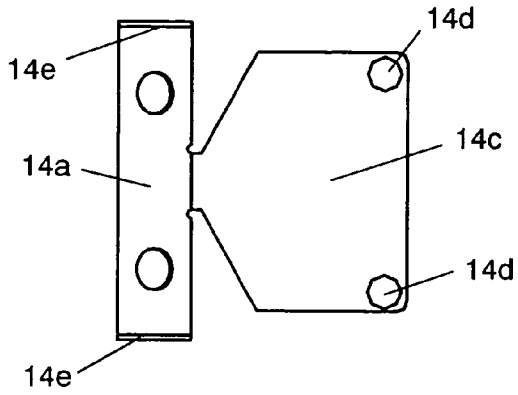
FIG. 4A is a plan view of a movable plate of the device.
Figure 4B:
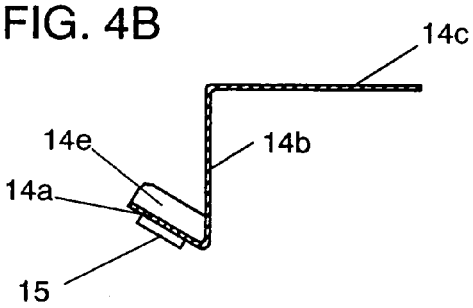
FIG. 4B is a vertical section of the movable plate.

FIG. 4A is a plan view of the movable plate 14, and FIG. 4B is a vertical section of it. The supporting member 14*c* is generally a pentagon, and it has circular holes 14*d*, 14*d* at both corners of the back section so as not to drop off from the fixing member 13 after it was insert-molded into the fixing member. The leg 14*b* is a narrow rectangle, and it extends downward from the edge of the supporting member 14*c* to connect between the supporting member 14*c* and the contact member 14*a*. The contact member 14*a* is also a narrow rectangle and has standing pieces 14*e*, 14*e* at both ends in the longitudinal direction of it for improving a current breaking property. The standing pieces 14*e*, 14*e* are formed by bending the both ends of the contact member 14.

Figure 5A:
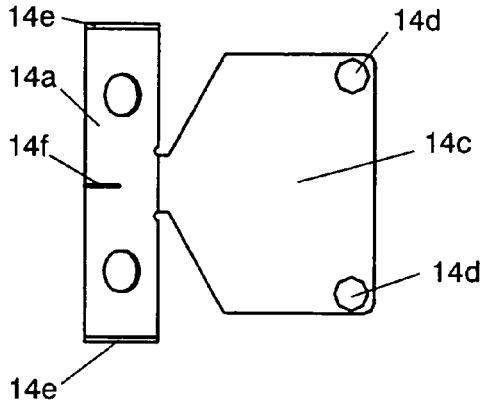
FIG. 5A is a plan view of a preferred movable plate of the device.
Figure 5B:
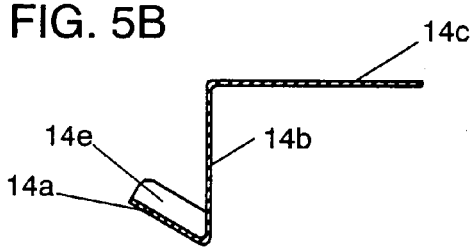
FIG. 5B is a vertical section of the movable plate.
Figure 13:
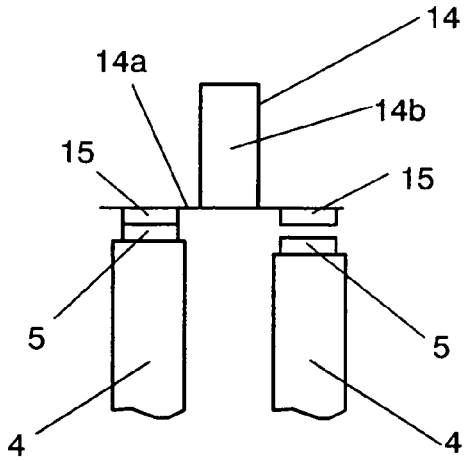
FIG. 13 (PRIOR ART)

Preferably, as shown in FIGS. 5A and 5B, the contact member 14*a* has a cut 14*f* between the movable contacts 15, 15. In general, when a contact device turns on or turns off a direct current of high voltage, it is necessary to raise an arc voltage to (or higher than) a voltage between contacts so as to extinguish the arc in the shortest possible time. Therefore, in this embodiment, two contact pairs are prepared to raise the arc voltage. However, if the distance between the fixed contact and the movable contact differs between the two contact pairs because of variations in parts dimension, mounting accuracy, and so on, a condition where only one contact pair makes the contacting engagement and the other contact pair does not make the contacting engagement may arise, as shown in FIG. 13. In such a case, a time in which each contact is exposed to the arc may differ between the contact pairs, and, as a result, the amount of wear of the contact material and the amount of transfer of it may vary from contact to contact This may lead to a malfunction. By providing the cut 14*f*, the stiffness of the contact member 14*a* is decreased, which makes it easy for the contact member 14*a* to deform in a moving direction of the contact plate. Therefore, even if there is a difference in distance between the two contact pairs, the contact member can absorb the difference by deforming. In addition, in this embodiment, the cut 14*f* is located on a center line in the longitudinal direction of the contact member 14*a*, and it extends from one edge of the contact member to the center of it.

Figure 6A:
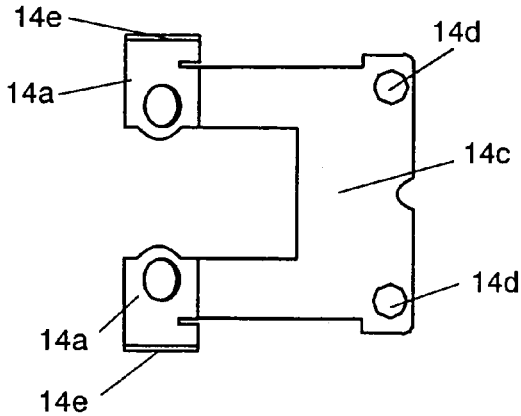
FIG. 6A is a plan view of another preferred movable plate of the device.
Figure 6B:
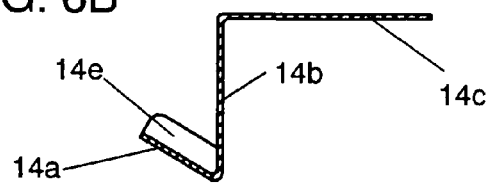
FIG. 6B is a vertical section of the movable plate.

As a substitute for the cut 14*f*, as shown in FIGS. 6A, 6B, two contact members 14*a*, 14*a* may be provided to absorb the difference in distance of the contacts. Each contact member is connected to the supporting member 14*c* through the leg 14*b*.

Figure 7A:
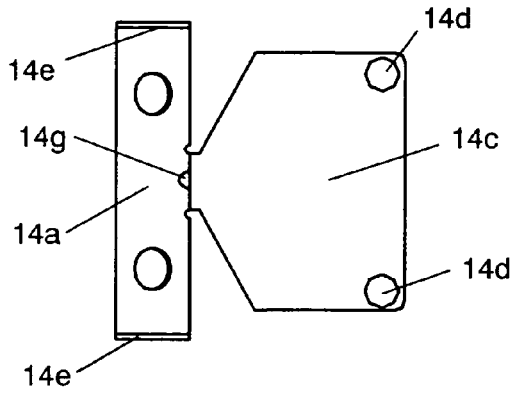
FIG. 7A is a plan view of another preferred movable plate of the device.
Figure 7B:
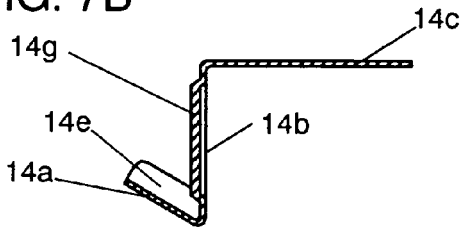
FIG. 7B is a vertical section of the movable plate.

Preferably, as shown in FIGS. 7A, 7B, the leg 14*b* has a long and narrow protrusion 14*g* running along a direction in which the leg 14*b* upstands (in other words, a longitudinal direction of the leg). The protrusion 14*b* enhances the strength of the leg, so it can prevent the buckling of the leg 14*b* even if an excessive stress is applied thereto.

Figure 8A:
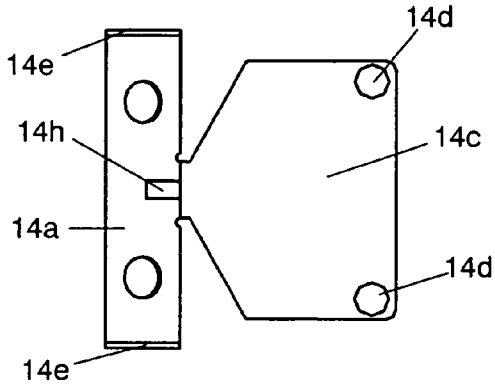
FIG. 8A is a plan view of another preferred movable plate of the device.
Figure 8B:
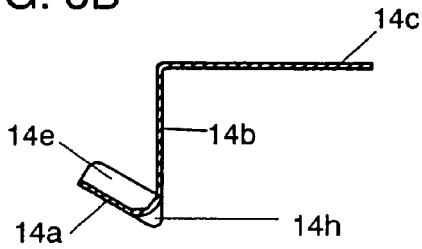
FIG. 8B is a vertical section of the movable plate.

It is also preferable that a protrusion 14*h* which is in contact with both surfaces of the leg 14*b* and the contact member 14*a* is provided at a connecting part between the leg and the contact member, as shown in FIGS. 8A, 8B. The protrusion 14*h* can prevent a change of the angle of the movable member 14*a* with respect to the leg 14*b*. If the angle of the movable member 14*a* with respect to the leg 14*b* changes when the movable plate 14 overtravels, the direction in which the contact pressure F acts will deviate from a direction normal to the contact surface defined between the fixed contacts and the movable contacts. By preventing the change of the angle by providing the protrusion 14*h*, it becomes possible to maintain the state where the contact pressure F acts in the direction normal to the contact surface, and the side slip of the movable contacts can be prevented certainly.

Figure 9A:
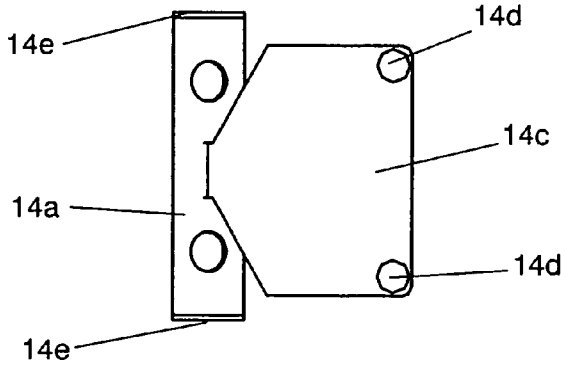
FIG. 9A is a plan view of another preferred movable plate of the device.
Figure 9B:
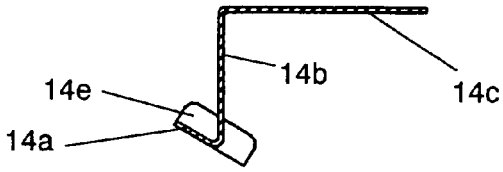
FIG. 9B is a vertical section of the movable plate.

Alternatively, as shown in FIGS. 9A, 9B, it is also preferable that the leg 14*b* upstands from a line joining each center of the two movable contacts. In this case, even if the angle of the contact member 14*a* with respect to the leg 14*b* varies when the movable plate 14 overtravels, the variation of the angle of the movable contacts can be minimized. Therefore, it becomes possible to suppress a deviation of the contact pressure F from the direction normal to the contact surface, and the side slip of the movable contacts can be prevented certainly.

Figure 10A:
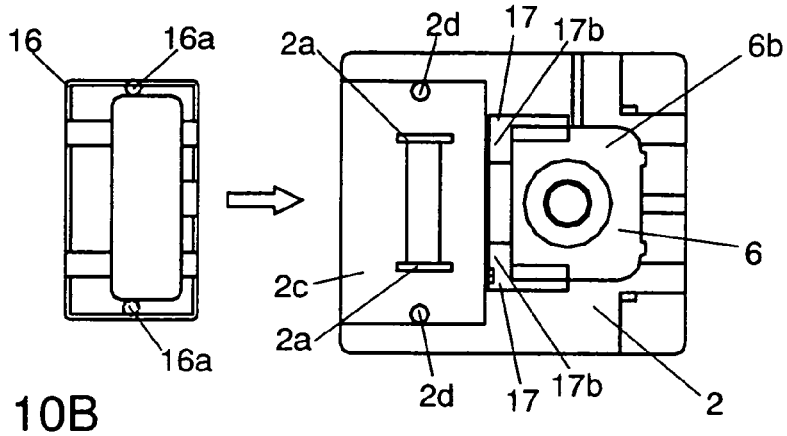
FIG. 10A and FIG. 10B are diagrams for explaining a base and an arc-extinguishing box of the device.
Figure 10B:
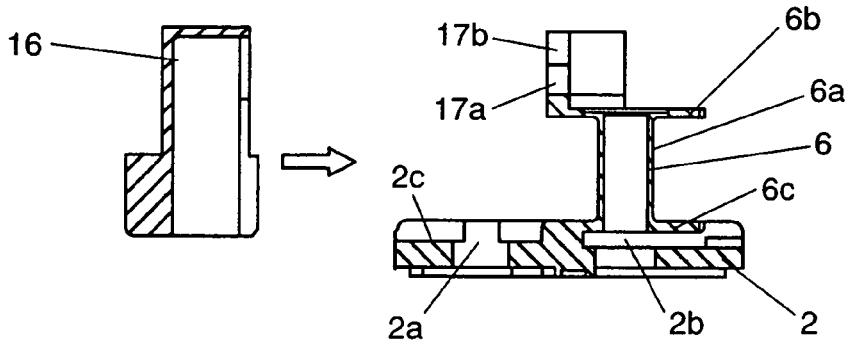

As shown in FIGS. 10A, 10B, in this contact device, the base 2, the bobbin 6, and the stopper 17 are integrally molded from the same material (a synthetic resin having an insulating property). The stopper 17 comprises two L-shaped pieces located at both edges of the flange 6*b* along a direction perpendicular to the longitudinal direction of the base 2, and each piece further comprises a vertical member 17*a* upstanding in the axial direction of the bobbin 6 from the upper surface of the flange 6*b* and a cross-member 17*b* extending inward from the top of the vertical member 17*a*. The pivot motion of the movable plate 14 is regulated when the supporting member 14 comes in contact with an under surface of the cross-member 17*b*. By integrally molding the base 2, the bobbin 6, and the stopper 17, the number of parts can be reduced, which enables a simplification of an assembly work and a cost reduction.

The base 2 has a recessed area 2*c* with an upper part and a left side surface in FIG. 10B opened, and the arc-extinguishing box 16 is slid thereinto from the left side and attached to it. The positioning of the arc-extinguishing box 16 with respect to the base 2 can be done easily by fitting two protrusions 2*d*, 2*d* provided at the bottom of the recessed area 2*c* into two recesses 16*a*, 16*a* provided on the under surface of the arc-extinguishing box 16.

The height of the arc-extinguishing box 16 and the length of the fixed terminal 4 are decided so that the fixed contacts are located in the middle of the arc-extinguishing box in height. Therefore, when the movable contacts come in contact with the fixed contacts, the size of the space upper than the contacts in the arc-extinguishing box 16 becomes equal to that of the space lower than the contacts, so the space for stretching the arc generated when the contacts are opened or closed can be divided equally.

Figure 11A:
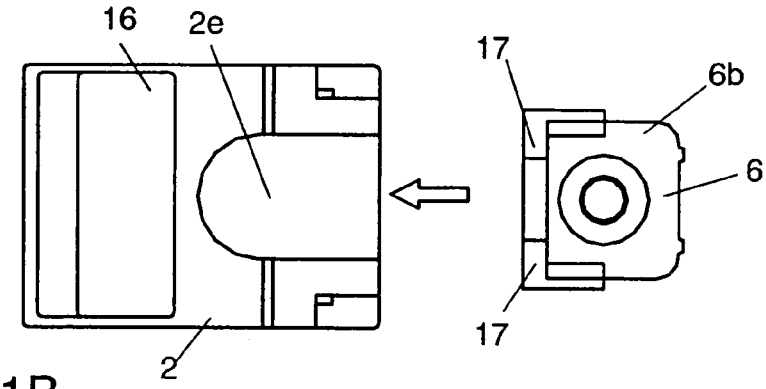
FIG. 11A and FIG. 11B are diagrams for explaining a base and a bobbin in accordance with another embodiment of the present invention.
Figure 11B:
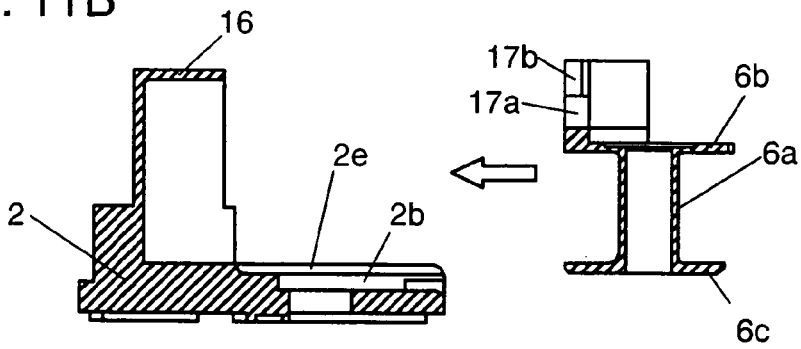
Figure 12A:
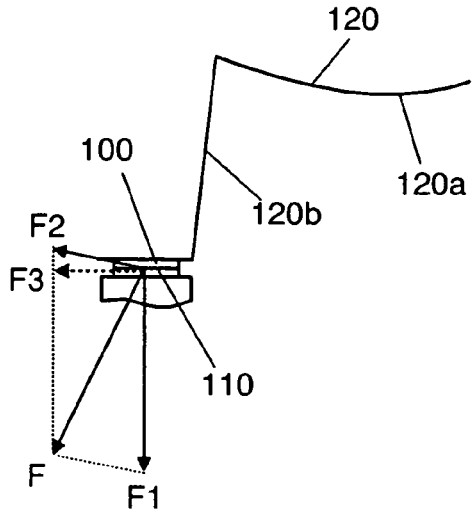
FIG. 12A (PRIOR ART)
FIG. 12A, FIG. 12B and FIG. 13 are diagrams for explaining a conventional contact device.
Figure 12B:
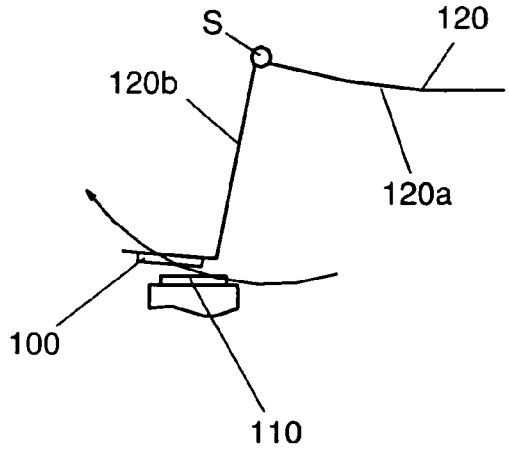
FIG. 12B (PRIOR ART)

Although the base 2, the bobbin 6, and the stopper 17 are integrally molded in this embodiment, the base 2 and the arc-extinguishing box 16 may be integrally molded from the same material (a synthetic resin which has an insulating property and excels in an arc-extinguishing property). In this case, the base 2 has a recessed area 2*e* with an upper part and a right side surface in FIG. 11B opened, and a integrally-molded bobbin 6 with the stopper 17 is slid thereinto and fixed thereto by an adhesive. In this case too, the number of parts can be reduced, which enables a simplification of an assembly work and a cost reduction.

In another embodiment, as a substitute for the arc-extinguishing box 16 and the cover 3, an arc-extinguishing which is attached to the base so that it surrounds the fixed contacts and the movable contacts and covers the drive mechanism may be used. That is, the housing 1 is composed of the base 2 and the arc-extinguishing cover, and the arc-extinguishing cover is used both as the arc-extinguishing box 16 and the cover 3. The arc-extinguishing cover is formed from a synthetic resin which has the insulating property and excels in the arc-extinguishing property. In this embodiment too, the number of parts can be reduced, and an assembly work can be simplified, and the cost can be reduced.

The invention claimed is:

1. A contact device comprising:

fixed terminals respectively provided with fixed contacts;

a movable plate carrying movable contacts each making a contacting engagement with each one of said fixed contacts;

a drive mechanism which drives said movable plate to make the contacting engagement of said movable contacts with said fixed contacts;

a housing which accommodates therein said fixed contacts, said movable plate, and said drive mechanism;

wherein said movable plate being a Z-shape having a contact member carrying said movable contacts, a leg upstanding from said contact member, and a supporting member which is coupled at its one end to said leg and is fixed at the other end to said drive mechanism, said movable contacts being given a first force by said drive mechanism along a direction for bringing said movable contacts into contact with said fixed contacts and given a second force by deformation of said supporting member resulted from an overtravel of the movable plate through said leg, said fixed contacts and said movable contacts being arranged such that a resultant force of said first force and second force acts in a direction normal to a contact surface defined between said fixed contacts and said movable contacts.

2. The contact device as set forth in claim 1, wherein said contact member has a cut between said movable contacts.

3. The contact device as set forth in claim 1, wherein said leg has a protrusion running along a direction in which said leg upstands.

4. The contact device as set forth in claim 1, further including a protrusion which is in contact with both surfaces of said leg and said contact member at a connecting part between said leg and said contact member.

5. The contact device as set forth in claim 1, wherein said contact member has two movable contacts, said leg upstanding from a line joining each center of said two movable contacts.

6. The contact device as set forth in claim 1, wherein said drive mechanism has a bobbin on which a coil is wound, said housing having a base which each of said fixed terminals penetrates, said base and said bobbin being integrally molded from the same material along with a stopper for restricting a movement of said movable plate in a direction in which said movable contact separates from said fixed contacts.

7. The contact device as set forth in claim 1, wherein said housing has a base which each of said fixed terminals penetrates, said base being integrally molded from the same material with an arc-extinguishing box that surrounds said fixed contacts and said movable contacts to extinguish an arc generated between said fixed contacts and said movable contacts.

8. The contact device as set forth in claim 1, wherein said housing comprises a base which each of said fixed terminals penetrates and an arc-extinguishing cover which is attached to said base so that it surrounds said fixed contacts and said movable contacts to extinguish an arc generated between said fixed contacts and said movable contacts and covers said drive mechanism.

* * * * *